United States Patent [19]

Eaton

[11] Patent Number: 4,854,594

[45] Date of Patent: Aug. 8, 1989

[54] METHOD OF PLAYING A BOARD GAME

[76] Inventor: Ronald E. Eaton, 7284 Monon Ct., Indianapolis, Ind. 46256

[21] Appl. No.: 230,051

[22] Filed: Aug. 9, 1988

[51] Int. Cl.[4] ..... A63F 3/00

[52] U.S. Cl. ..... 273/249; 273/240; 273/280

[58] Field of Search ..... 273/249, 272, 243, 240, 273/273

[56] References Cited

U.S. PATENT DOCUMENTS

| | | | |
|---|---|---|---|
| 4,089,527 | 5/1978 | Roth | 273/249 |
| 4,090,717 | 5/1978 | Rossetti | 273/249 |
| 4,561,658 | 12/1985 | Peterson | 273/243 |
| 4,572,514 | 2/1986 | Aponte | 273/255 |
| 4,613,134 | 9/1986 | Tobin | 273/242 |
| 4,640,513 | 2/1987 | Montijo | 273/249 |
| 4,666,161 | 5/1987 | Elesie | 273/249 |

*Primary Examiner*—Edward M. Coven
*Assistant Examiner*—Benjamin Layno
*Attorney, Agent, or Firm*—Woodard, Emhardt, Naughton, Moriarty & McNett

[57] ABSTRACT

A game board for two to four players which eliminates virtually all aspects of luck and requires both knowledge and skill as to the strategy of play includes a generally square game board consisting of a plurality of squares which are arranged in a matrix fashion and include a plurality of game question cards. A Pocket is formed on each square and a question card is placed faced down in each square. To start play a question on a challenge list card is read to all the players. The question has several correct answers. The players list as many correct responses as they can. The player with the most correct responses has the right to move first along the spaces. The number of spaces to be moved directly corresponds to the number of correct responses. In order for a player to move and remain on the advanced square, the question corresponding to the game question card on that square must be answered correctly then that player's turn is over. The other players in order, depending on the number of correct responses, similarly advance their playing pieces. After all players have had a chance to move and either correctly or incorrectly answered the corresponding game question, a new challenge list question is answered and the process repeats. The winner is the first player to move his/her game piece around the game board and correctly answers a game-ending question.

7 Claims, 4 Drawing Sheets

METHOD OF PLAYING A BOARD GAME

BACKGROUND OF THE INVENTION

The present invention relates in general to board games wherein the object is to move game (player) pieces along a particular path to a game-ending objective where the order of play and movement along the path are governed by specific rules. More particularly, the present invention relates to such a game wherein the path is a variable, determined by the players, and movement of the game pieces is controlled by player skill and knowledge in answering questions rather than by the roll of a die or dice or by other pure-chance techniques.

We are familiar with certain well-known board games such as "Monopoly," wherein the path around the board is fixed and movement of the game (player) pieces, typically referred to as "men," is controlled by the number rolled on a pair of dice. In the game of "Monopoly" the men move continuously around the fixed path set forth on the board until one player accumulates a majority of the wealth and the other players are either bankrupt or nearly so. There are other board games where the end of the path signifies the end of the game, such as "Trivial Pursuit" or "Pictionary." In these two games, there is an element of skill, for in "Trivial Pursuit" continued movement on the path is enabled by answering trivia questions correctly. In Pictionary, continued movement depends on skillfully sketching a word or phrase and a team-mate correctly guessing what has been sketched. Even with some aspects of skill, these games include a substantial and in fact controlling element of luck. The roll of the dice determines how many spaces the men can move, and thus the category of question to be answered or the word to be sketched is dependent in part by one's luck in rolling dice.

In the present invention, any element of luck is virtually nonexistent. The moves of the men are initially determined, both as to the order of play and the distance (number of squares) able to be moved, based upon answers to a "list" question. Whether the allowed move is in fact completed depends on answering another question correctly. Granted, some element of luck can exist based upon what question is asked, but the player has control to a great extent as to the topic or category of the question. The path the men follow is also under the control of the players. Since the game board is basically a matrix of squares, and since movement can be in virtually any direction except diagonally, a player having a move of four spaces, for example, can end up on different squares, with each square having a different topic or category of question.

In addition to the three games already mentioned, applicant is aware of other games which might be regarded as being of interest relative to the present invention. Each of these games, represented by an issued patent, is listed below followed by a discussion of its relationship to the teachings of the present invention.

| Patent No. | Patentee |
|---|---|
| 4,640,513 | Montijo |
| 4,613,134 | Tobin |
| 4,572,514 | Aponte |
| 4,089,527 | Roth |

Montijo discloses a memory game involving elements of skill and chance which is played on a circular board having concentric bands segmented into individual squares. Players take turns trying to spell, pronounce and define words correctly, remember number sequences, answer question cards, play game chips on the squares of the board and play the bonus chance game. All seven functions are played simultaneously as the game progresses. The first player to reach the winner's circle by completing movement around the board and fulfilling the required activities is the winner.

Tobin discloses a board game wherein the board is delineated with a uniform rectilinear grid defining eight adjacent rows and columns of square spaces. Each space is associated with one of four types of zones, a home zone, a side zone at each end and a safe zone. Each player controls a plurality of game pieces having distinct values indicating the number of spaces the piece can move during a turn. Scoring is dependent on the number and value of pieces reaching the opponent's home zone, the number and value of pieces captured, the positions of the pieces at the end of the game, and whether captured pieces had previously entered the safe zone to avoid capture.

Aponte discloses a military game featuring in one aspect a game board marked with a multiplicity of columns, each column being marked into a multiplicity of spaces and having uniquely associated with it indicia of a type of military force, a multiplicity of playing pieces, each piece being marked with corresponding indicia of the types of military force, and a pair of dice, each face of one die being uniquely marked with corresponding unique indicia of the types of military force and each face of the other die being marked with a number. The throw of the dice determines which of the playing pieces are to move and the number of spaces to be moved. The columns also have spaces designating cards. An award chart is provided identifying awards for playing pieces moved all the way along a column and being placed on a separate continent block.

Roth discloses a game which can be played by 2–4 persons and requires memorization, generally by association, of certain predetermined facts to be successful at winning. The game apparatus comprises a board which defines a playing field having marked squares defining a continuous path or course extending about the board, a plurality of numbered memory cards or a memory list, four colored playing pieces, a clock, dice, a deck of luck cards and a number of marker cubes. The board squares include numbered squares which carry written or graphic indicia and which correspond numerically to the memory cards, luck squares which are associated with the luck cards and opportunity squares. When a player lands on a square, the square is then his and is marked by one of his marker cubes. The opponents are given one minute to memorize the corresponding memory card which provides assorted and variable information such as a state and its captial and sometimes an illustration of the information. The information to be recalled may be memorized by association with indicia on the corresponding number square or may be memorized by association with the illustration (where provided) on the memory card. If an opponent thereafter lands in the controlled square, the player who controls can request that the opponent recall information on the corresponding memory card and also one other memory card corresponding to another square controlled by the player. The memory cards have on them illustrations, a player asked to recall the card is allowed to see the illustration. Failure to recall on the part of any player requires that player to restart.

As should be apparent from the foregoing descriptions of the four references, each board game involves substantial elements of chance and luck, one particular example being the use of dice to control the moves which a player may make. As can also be understood from the illustrations provided as part of each of the four listed patents, the various paths which are defined are fairly specific and would not be considered variables. In contrast, the present invention does not rely on any substantial elements of luck, and the moves of the men and the manner in which they move are controlled exclusively by a player's ability to answer certain questions and his individual playing skills and game strategy. The present invention provides a unique and challenging board game which relies heavily on the player's knowledge and skill blended with a substantial degree of challenging strategy in order to be the first to achieve the game-ending objective.

SUMMARY OF THE INVENTION

A board game for testing one's knowledge and skills in planning and strategy according to one embodiment of the present invention comprises a game board arranged into a plurality of contiguous game spaces, the game spaces including a starting block and question spaces, a plurality of game pieces for use by players, the playing pieces being positionable on the game spaces, a first plurality of question cards including move-ending question cards and game-ending question cards, the cards being initially disposed on the question spaces, a second plurality of question cards including move-ending question cards and game-ending question cards which are usable as replacements for cards of said first plurality, a plurality of list question cards, each card having a list question requesting as an answer a list of at least two responses and a plurality of listing sheets for each player to record answers to the list questions, the list of answers of each player to each list question being determinative of the order of play and the number of spaces moved by each player's game piece.

A method for playing a game on a board having a substantially flat, top surface on which is delineated a grid defining a plurality of contiguous spaces disposed with replaceable game question cards, a starting block and a center hub, according to another embodiment of the present invention comprises a series of steps which must be followed according to the rules of the game and wherein the game question cards include regular question cards, and game-ending question cards, the contiguous spaces arranged in a defined path from the starting block to the game-ending question cards, the game further including a game piece for each player. The method of play comprises placing each player's game piece in the starting block, asking the first list question of all players, each player preparing a list of responses in answer to said first list question, each player moving in turn from the starting block to a move-ending game board square, the move being based on the number of correct responses to the first list question, restricting movement of the game pieces to only horizontal and vertical directions thereby preventing diagonal moves and further restricting the movement such that contact with a square is limited to one time by any one piece as part of any one move, requiring a different question to be answered correctly by each player for the player's game piece to remain on the move-ending game board square, the question to be asked corresponding to the game question card disposed on the square occupied by the particular game piece, removing each game question card from its corresponding game board square when the corresponding question is answered correctly, thereby leaving the game board square void of any game question card, replacing each game question card with a new game question card when the corresponding question is answered incorrectly, after each player has made its initial move and responded to the particular question, asking another list question of all players, each player preparing a list of responses in answer to said another list question, each player moving in turn from its then-present position to a move-ending game board square based on the number of correct responses to said another list question and repeating the seven foregoing steps until a first game-ending question is answered correctly.

One object of the present invention is to provide an improved board game and an improved method for playing the board game.

Related objects and advantages of the present invention will be apparent from the following description.

DESCRIPTION OF THE PREFERRED EMBODIMENT

Figure 1:
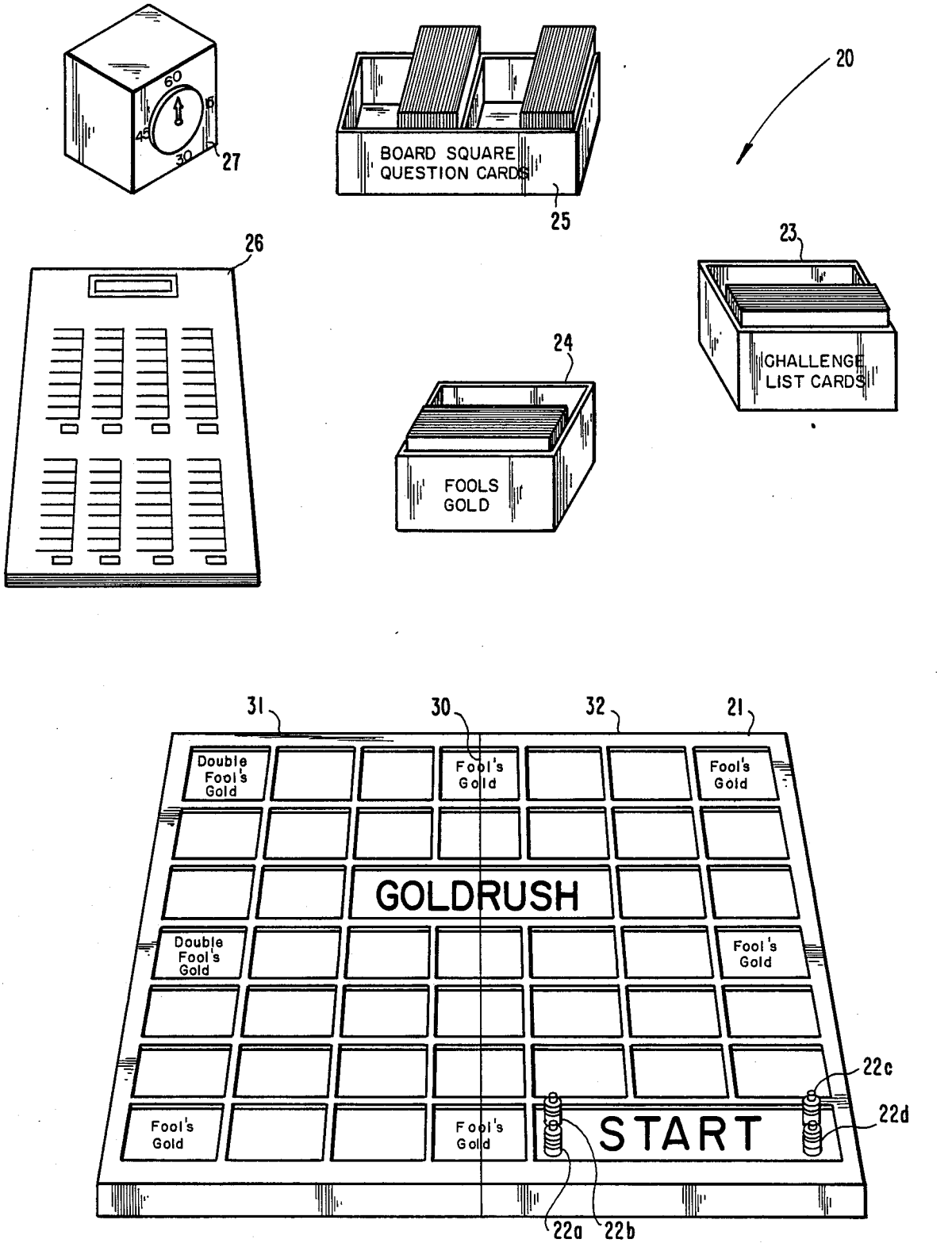
FIG. 1 is a perspective view of a board game including all accessories and components according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
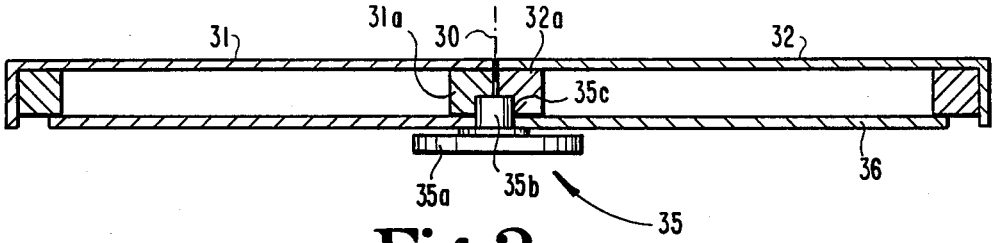
FIG. 2 is a front elevation view in full section of the FIG. 1 game board as arranged on a swivel support.

Referring to FIG. 1, there is illustrated the game board and accessories which constitute the game of the present invention. The game 20 includes board 21, four two-part cones (men) *22a–22d*, one box of challenge list cards 23, one box of fool's gold cards 24, one box of game board question cards 25, challenge list answer pads 26 and multiple interval timer 27. Board 21 is configured in a hinged manner along centerline 30 and the underside is hollowed such that the closing of halves 31 and 32 (such that the playing surface is exposed) creates a storage area inside for the various cards and accessories used with the game. The underside of the board is configured with a "lazy-susan" arrangement 35 (see FIG. 2) which is initially provided disassembled with the components stored within the enclosed storage area. Once these components are assembled, the opened and set up game board can freely rotate on the "lazy-susan" arrangement. The "lazy-susan" arrangement includes a base 35*a* and a pivot post 35*b* which is received by spanning brace 36. Inner ribs 31*a* and 32*a* receive two hinges 30*a* along centerline 30 and inbetween these two hinges is circular recess 35*c* which receives post 35*b*.

Figure 3:
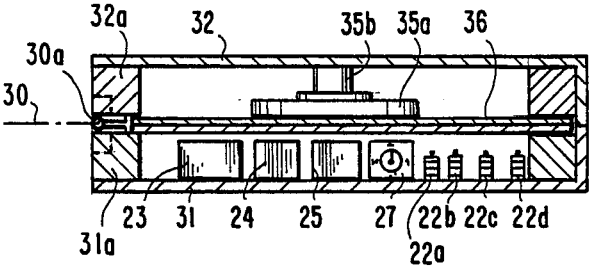
FIG. 3 is a side elevation view in full section of the FIG. 1 game board as folded so as to define an enclosed space for retention of game accessories.

FIG. 3 illustrates the closed condition of the two board halves, the location of the hinge connecting the two halves and the manner in which a center or interior storage area is defined by the hollowed or recessed undersurface of each half.

Figure 4:
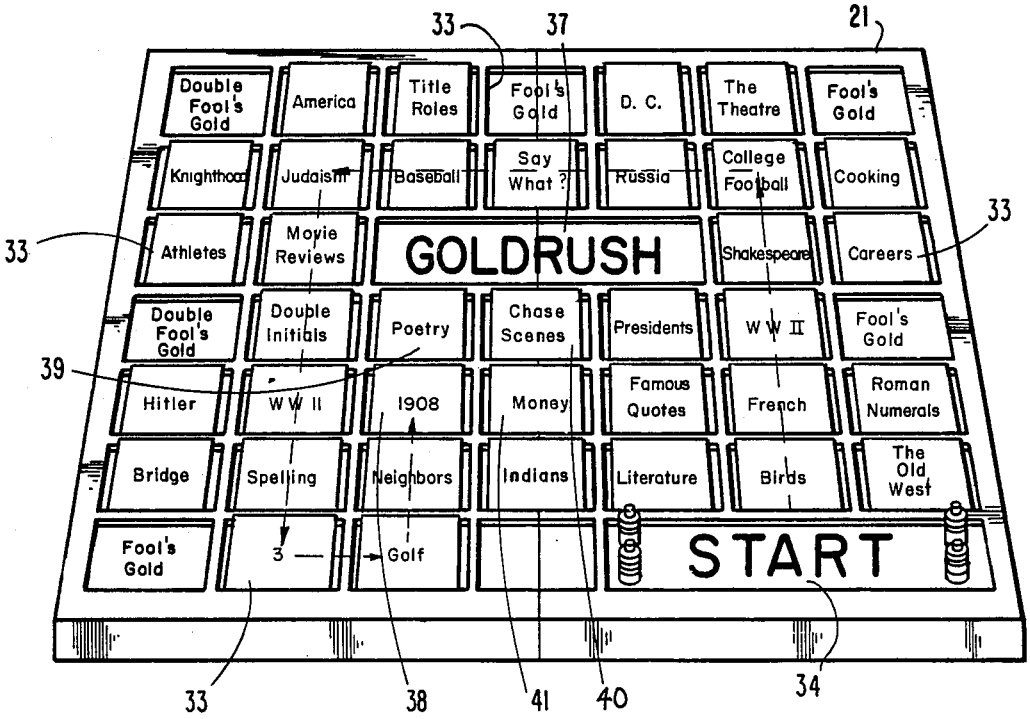
FIG. 4 is a perspective view of the FIG. 1 board set up for the start of the game with question cards applied to the various game board squares.

Referring to FIG. 4, the completely set-up ready-for-play game board 21 is illustrated. Dimensionally the board 21 is approximately 18 inches by 18 inches (though almost any size is acceptable) and is separated into a 7 by 7 matrix which delineates 49 square areas 33. Three of these square areas are used for the name "Goldrush" and the presence of this three-square block creates a center hub 37 around which the path of play progresses from the starting block 34 to one of four game-ending squares which will be described hereinafter. Three squares are used for the starting block 34 leaving 43 squares from the original total of 49. Five of these 43 squares are designated "Fool's Gold" and two are designated "Double Fool's Gold" and the playing of these square areas will be described hereinafter. The four men are positioned in the starting block 34, one for each player, though the game is designed for from two to four players. The uniformity of the 7×7 matrix and the 49 spaces (squares) defined as was clearly evident in the FIG. 1 illustration, has now been utilized for the placement of game cards in all squares except for the block of three squares defining the central hub 37 and the block of three squares comprising the starting block. As evident from the indicia thereon, there are seven squares marked as either Fool's Gold or Double Fool's Gold. Since the squares are permanently marked, they do not require any cards to be placed thereon. Thirty-two regular category game question cards have been arranged on the remaining squares with the exception of four gold cards 38, 39, 40 and 41 which have been placed in a 2×2 matrix adjacent and below the center hub 37. As will be described hereinafter, certain contrasting color barriers are applied to the game board which aid in alerting and reminding the players about restrictions to the direction of movement of the game pieces. These barrier aid in creating a pathway, though the individual moves are variable, and the first individual to follow the path and reach one of the four gold cards just described and answer the corresponding question correctly is declared the winner of the game. The five arrows in broken-line form which are superimposed on the question card represent one possible path from the starting block 34 to gold card 38.

Figure 5:
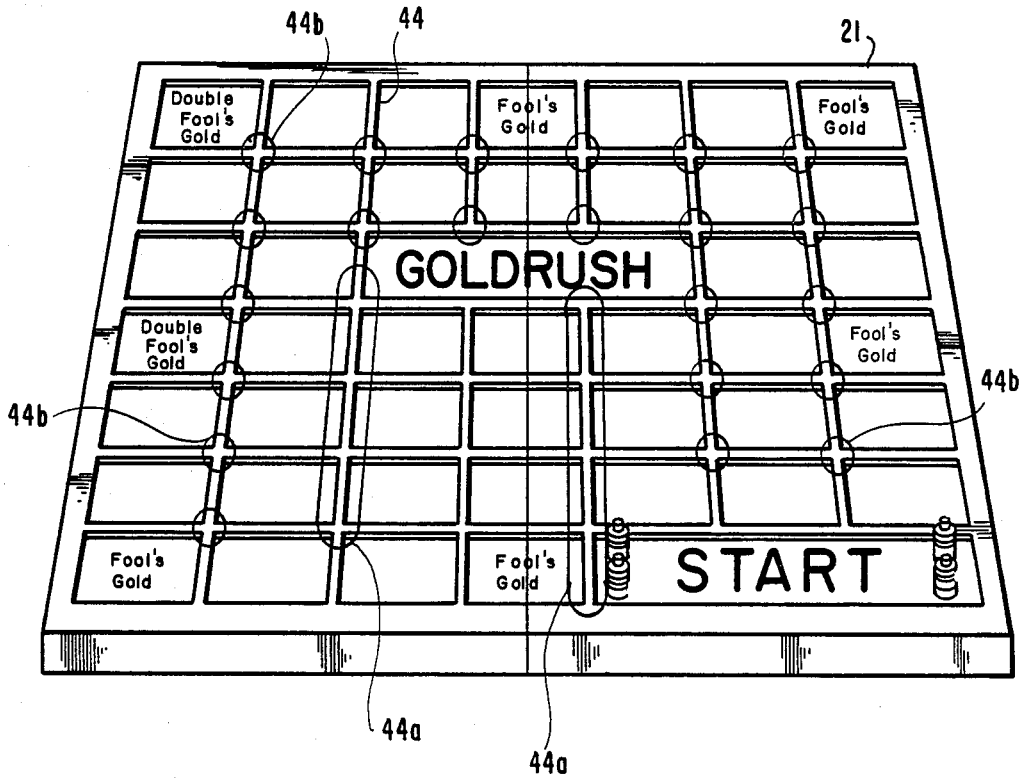
FIG. 5 is a diagrammatic illustration of the FIG. 1 game board with special notations added to point out the location of contrasting colored barriers.

Referring to FIG. 5, the game board 21 of FIG. 4 is illustrated in diagrammatic form. The two oblong outlines encircle a portion of the board dividing one series of squares from an adjacent series of squares. On the actual board each square is separated from adjacent squares by a slightly raised rib 44. In the case of the two oblong outlines 44*a*, the encircled ribs are of a contrasting color relative to the remaining ribs and in the preferred embodiment, this contrasting color is black. This contrasting color denotes a barrier which cannot be crossed by the men during the play of the game and movement of the men from the starting block to the various question card squares. Additionally, each corner of each square that comes into play is of the contrasting color indicating that movement of the men from one square to a contiguous square cannot be made diagonally across these corners. The moves which the men can make as part of any one turn are limited to vertical and horizontal paths and the corners which are of a contrasting color (black) cannot be crossed as part of a diagonal move. For illustrative purposes, these corners are identified by circles 44*b* and there is a total of twenty-four.

Figure 6:
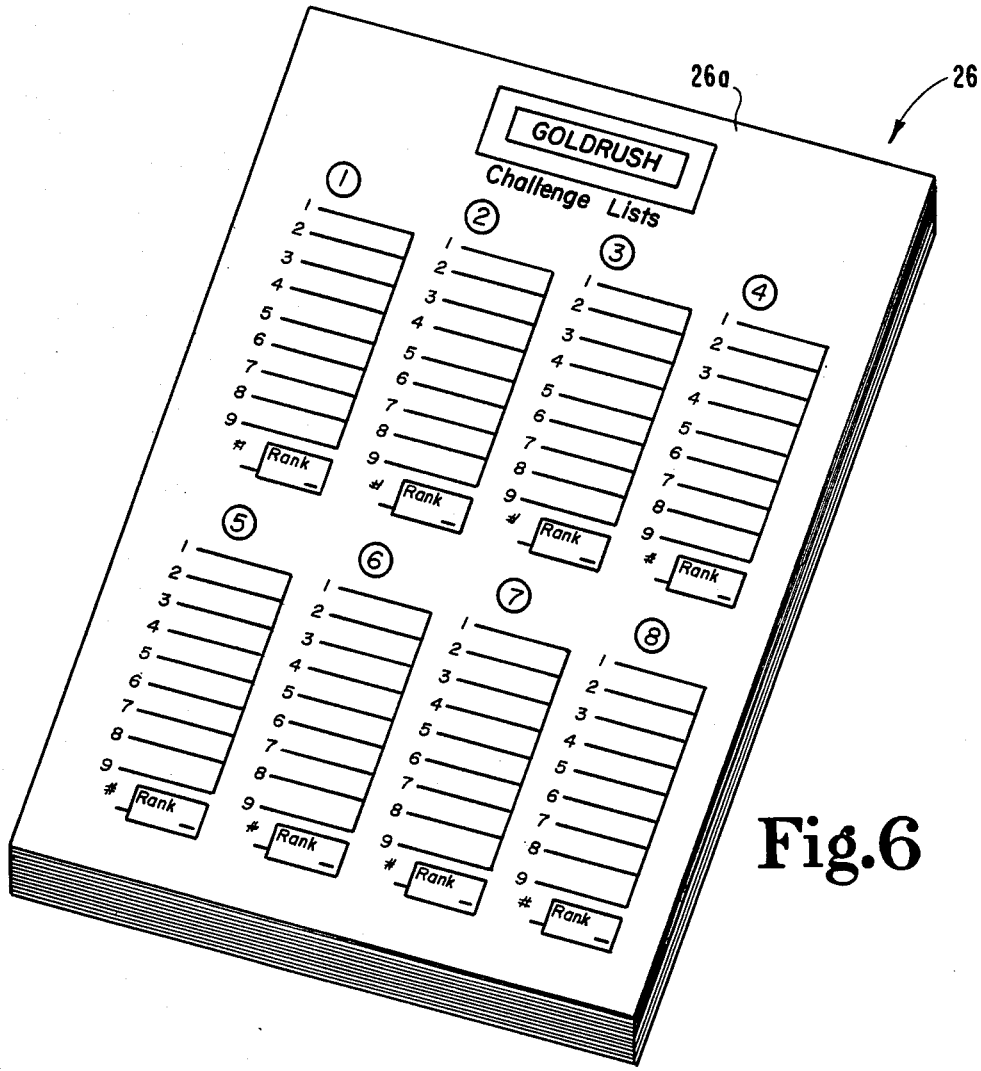
FIG. 6 is an enlarged perspective of the list answer sheet illustrated in FIG. 1.
Figure 7:
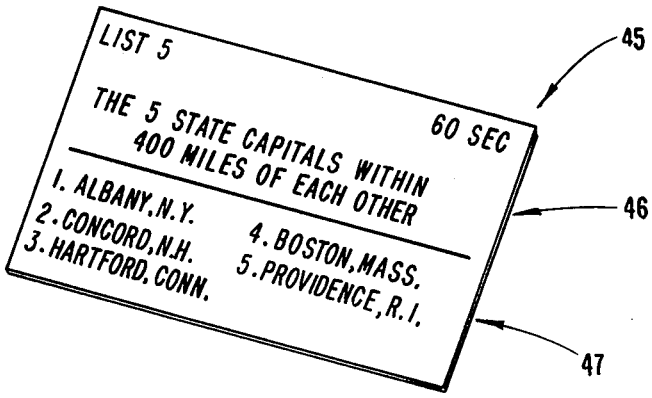
FIG. 7 is a perspective view of a list card comprising a portion of the FIG. 1 board game.

Referring to FIG. 6, there is an enlarged detail of one sheet from the challenge list answer pad 26 (see FIG. 1) and this single sheet represents one of a plurality of identical sheets which are part of each answer pad and which are used by each player. This particular sheet 26*a* is configured with eight columns for recording a player's listing of answers in response to eight different challenge list questions. Each challenge list card contains one challenge list question and indicates the maximum number of responses to be made in answer and the time allowed to each player to respond to the challenge list question. A sample challenge list card 45 is illustrated in FIG. 7. The upper left corner denotes "list 5" and the upper right-hand corner indicates "60 seconds." The card is divided into a top half 46 with the question and the lower half 47 with the five correct answers. The card is split in this fashion so that the question can be read without revealing the answers and then at the end of the 60-second period, the answers are exposed and each player scores his/her list. If the question on card 45 is the first challenge list question, then the players write their answers under list 1 on their corresponding answer pad. Note that one answer pad 26 is provided to each player.

Timer 27 (FIG. 1) has three settings, one at 30 seconds, one at 45 seconds and one for 60 seconds. While other intervals are an option and any number of timers will suffice, the described timer is preferred because of its simplicity of operation and ability to easily identify and set the selected intervals for the game.

With the foregoing structure in mind, the play of the game will now be described. The first step is to open the game board and set up the men and cards as previously described, including setting up the "lazy-susan" for free rotation of the board. Next the 32 regular category question cards 25 and four gold question cards 38–41 are randomly placed in their designated spaces (i.e., squares 33). While placement is random, the four gold question cards must be placed on the four squares indicated so as to constitute the end of the path and ultimately the end of play. Each player is given a challenge list pad (and pencil) and one player is assigned the responsibility for reading the challenge list questions and starting the timer 27. The object is to progress from the start position (starting block 34) and move by a series of correct answers to the gold card section beneath the center hub. The winner is the first player (or team) to advance to and correctly answer a gold card question.

The men are moved a number of spaces according to the number of correct responses to the corresponding challenge list question. For example, three correct responses to a challenge list question means a three-square advance by that particular player. During the play, the man moved by the player may not touch any square more than once per move (advance). As previously noted, the player may not move diagonally from one square to another. The player must move exactly the number of spaces earned based upon his answers to the challenge list question(s). Each player should circle the number on his answer sheet (list pad) to remind himself of the number of responses requested. The reader should allow time for each player to analyze how many correct responses are ideal to reach his choice of possible destinations. The reader then slides the first challenge list card high enough above the edge of the storage box for the reader to see the first list request and reads it aloud for all players to hear. He then starts the timer and all players begin to list their responses (each member of the team may complete his own list and the lists will be combined later). A player may not end up with a list of more responses then requested. A player or team may delete responses in order to arrive at or below the maximum number permitted and at the desired level of advance. Players may abbreviate responses in order to increase the speed. No player may start a new response after the final buzzer (from the timer) goes off. After the timer buzzer sounds, time should be allowed for each player to delete any answers needed to arrive at the desired number of correct answers. If team play is involved, the team should compare their answers privately and circle final responses to be counted. It is important to note that no more than the requested number of responses from the challenge list can ever be used by a player or team.

Once all players have completed the desired number of responses to the challenge list question, the reader of the challenge list question then slides the card up further to reveal the list of correct responses and reads that list aloud slowly. As the responses are read, each player of the team checks the numbers beside the correct responses. The responses may be in any order. Each player or team then announces his number of correct responses and writes it in the space marked with the # symbol. The order and size of advance (move) is determined by beginning with the player which had the greatest number of correct responses. That player receives a ranking of #1 and then in descending order of correct responses, the other players are numbered as to a #2, #3 or #4 ranking. If two or more players tie on the opening challenge list question as to the number of correct responses, a coin may be flipped to determine the first player or the players may determine the order by mutual consent.

After establishing the ranking, each player or team should write his rank in the space marked "rank" on the list pad. Any subsequent ties will be broken by awarding the lower-numbered rank to the player with the lowest numbered rank from the previous list and going as far back as necessary to break the tie. The player (or team) ranked #1 will move first and will move exactly the number of the correct responses to the first challenge list question. A player may pass if his choices move him no closer to the gold cards. If the player with the #1 ranking desires a destination with a removable category card, he announces the category so that any opposing player may lift the card disposed in that space or on that square. The advancing player moves the top cone of his two-part game piece from its spot in the starting block to that particular game square and places that piece on the vacant destination. The opposing player which removed the category question card then reads the question on the back of that card and initiates the timer for 30 seconds.

If the advancing player is able to correctly answer the question within the time period allowed, he moves the other half of his playing piece from the starting point, in this case the starting block, and places it (reassembles it) to the other half previously moved thereby restoring the game piece to its original two-part assembled condition and placing that game piece in the square vacated by the card with the correctly answered question. This square then constitutes the starting square for the next move of this particular game piece. The particular space corresponding to the game question card which was correctly answered, shall remain blank or void of any question cards for the remainder of the game. If the player is incorrect in his answer to that particular game question card, he moves the advanced half of the game piece back to the original starting block where it is reassembled with the half which remained and the vacated space is then filled with the next category card from the storage box. All used or spent question cards should be placed in the designated space in the storage box indicating that they have been previously asked, regardless of the answer.

The Fool's Gold squares may be landed on by any number of players at any one time. These questions are no more difficult than the regular game question cards, but they cover a wide scope of knowledge and the particular category is completely random. Therefore, if the player would prefer to select a known category, these spaces should be avoided. If a player advances to a Fool's Gold square, the next Fool's Gold question card is pulled from the corresponding box of cards. Any opposing player may pull the Fool's Gold card from the box and read the question. The player pieces are then moved in the same manner as previously explained, advancing half of the game piece to the square and then either moving the other half to that square if the question is answered correctly or returning the advancing half to the starting block or to the prior square if the question is answered incorrectly. The Fool's Gold squares do not become voided if the question is answered correctly. If desired, the Fool's Gold (and/or Double Fool's Gold) spaces may be deleted by simply placing a regular question card over the square.

It will also be noted that on the game board there are two squares identified as "Double Fool's Gold" and although two are identified, it is possible to vary the number and location of Double Fool's Gold squares as well as the Fool's Gold regular squares. A Double Fool's Gold square is a chance to make up ground quickly on your opponent. A Double Fool's Gold square is handled in the identical manner as previously described for the regular Fool's Gold squares except if a player answers the question correctly, he advances to the square and is then allowed to make another advance of the same number of moves that got him there and attempt to answer yet another question. For example, if a player is eligible to move five squares and in so doing is able to land on the Double Fool's Gold square, and if he answers the question correctly, he may then move another five squares at which point the question must be answered in order to remain. The way in which the two Fool's Gold squares are positioned on the FIG. 4 game board means that a move of three, five or seven will allow the second Double Fool's Gold square to be reached after landing on the first Double Fool's Gold square.

After the player with rank #1 has completed his turn, each successive player will proceed in the same fashion. When all players have completed their initial move, the next challenge list question is drawn and read. Players record their responses in answer to that question in the column marked "2" and the play sequence repeats. The objective is to reach and answer correctly any one of four gold card questions.

Although one advantage of the present invention is the ability to exclude virtually an element of luck from the game, it is envisioned that some players may either like the element of luck or may prefer a faster or quicker version of the game when time does not permit to play a full game. Although winning the game should leave nothing to chance, that particular element may be sacrified. To do so, the game is played the same in all respects with the exception of replacing the challenge list questions with the role of a die. Each player rolls before each advance and the rank and tiebreaker systems are the same as in the standard version of the game.

Additional rules which may prove necessary or at least helpful include the following. When a persons's name is required for an answer, the last name is sufficient unless the request of first and last name is underlined. In any list asking for states, Washington, D.C. is not to be included. Any part of a category which is placed in quotation marks could be a clue to a word in the answer. The only "tricky" category is "In Other Words," wherein the statement on the card is a paraphrase of a well-known phrase or slogan but is simply stated in other words.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for playing a game on a board having a substantially flat top surface on which is delineated a grid defining a plurality of contiguous spaces disposed with replaceable game question cards, a starting block and a center hub, the game question cards including regular question cards and game-ending question cards, said contiguous spaces are arranged in a defined path from said starting block to said game-ending question cards, the game further including a game piece for each player wherein the method of play comprises:

(a) placing each player's game piece in the starting block;

(b) asking the first list question of to all the players;

(c) each player preparing a list of responses in answer to said first list question;

(d) each player moving in turn from the starting block to a move-ending game board square based upon the number of correct responses to said first list question;

(e) restricting movement of said game pieces to only horizontal and vertical directions thereby preventing diagonal moves and further restricting said movement such that contact with any square is limited to one time by any piece as part of any one move;

(f) requiring a different question to be answered correctly by each player for the player's corresponding game piece to remain on the corresponding move-ending game board square, the question to be asked corresponding to the game question card exposed on the square occupied by the particular game piece;

(g) removing each game question card from its corresponding game board square when the corresponding question is answered correctly, thereby leaving the game board square void of any game question cards;

(h) replacing each game question card with a new game question card when the corresponding question is not answered correctly;

(i) after each player has made its initial move and responded to the particular question, asking another list question of all players;

(j) each player preparing a list of responses in answer to said another list question;

(k) each player moving in turn from its then-present position to a move-ending game board square based on the number of correct responses to said another list question; and (l) repeating steps (e), (f), (g), (h), (i), (j) and (k) until a first game-ending question is answered correctly.

2. The method of claim 1 wherein as part of step (c), allowing the players a specific amount of time to prepare their list of responses in answer to said first list question.

3. The method of claim 1 wherein as part of step (f), allowing the players a specific amount of time in order to answer the question which is presented on the corresponding game question card.

4. The method of claim 1 which further includes the step of preventing any player from using as part of any move any game board square which is void as a result of an earlier move and a correctly answered question.

5. The method of claim 1 which further includes the step of prioritizing the order of play with respect to each list question by having the player with the greatest number of correct responses move first and the player with the next-greatest number of correct responses moving second and so forth through the final player.

6. The method of claim 5 wherein the number of spaces comprised in any move of any player must be exactly equal to the number of correct responses by that player to the corresponding list question.

7. The method of claim 6 wherein ties between players as to the order of moves based on the number of correct responses to a list question are broken by going to the number of correct responses to the prior list question and so forth until the tie is broken.

* * * * *